US009821973B2

(12) United States Patent
Sato et al.

(10) Patent No.: US 9,821,973 B2
(45) Date of Patent: Nov. 21, 2017

(54) IMAGE FORMING APPARATUS COMPRISING A SHEET FEED UNIT REMOVABLY MOUNTED

(71) Applicant: KYOCERA Document Solutions Inc., Osaka (JP)

(72) Inventors: Masaki Sato, Osaka (JP); Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/352,193

(22) Filed: Nov. 15, 2016

(65) Prior Publication Data

US 2017/0153589 A1 Jun. 1, 2017

(30) Foreign Application Priority Data

Nov. 27, 2015 (JP) ..... 2015-231514
Oct. 7, 2016 (JP) ..... 2016-199146

(51) Int. Cl.

| | |
|---|---|
| ***B65H 7/02*** | (2006.01) |
| ***G03G 15/00*** | (2006.01) |
| ***B65H 3/06*** | (2006.01) |
| ***B65H 1/14*** | (2006.01) |

(Continued)

(52) U.S. Cl.

CPC ..... *B65H 7/02* (2013.01); *B65H 1/14* (2013.01); *B65H 1/266* (2013.01); *B65H 3/06* (2013.01); *B65H 7/20* (2013.01); *G03G 15/6529* (2013.01); *B65H 2405/1117* (2013.01); *B65H 2511/417* (2013.01); *B65H 2511/51* (2013.01); *B65H 2513/53* (2013.01); *B65H 2551/27* (2013.01);

(Continued)

(58) Field of Classification Search

CPC ... B65H 1/04; B65H 1/14; B65H 1/18; B65H 1/266; B65H 3/0684; B65H 7/02; B65H 7/04; B65H 7/06; B65H 7/14; B65H 7/20; B65H 2405/1117; B65H 2553/612; B65H 2553/80; B65H 2553/83; B65H 2511/51

See application file for complete search history.

(56) References Cited

U.S. PATENT DOCUMENTS

2009/0066006 A1* 3/2009 Lee ..... B65H 7/04 271/8.1
2010/0090394 A1* 4/2010 You ..... B65H 1/266 271/162

(Continued)

FOREIGN PATENT DOCUMENTS

JP 2008-100824 A 5/2008

*Primary Examiner* — Prasad V Gokhale
(74) *Attorney, Agent, or Firm* — Stein IP, LLC

(57) ABSTRACT

An image forming apparatus includes an apparatus main body, a sheet storage cassette, a sheet feed unit, a first detection sensor having a first detector for detecting the presence/absence of sheets stacked on a sheet stacking plate, a second detection sensor having a second detector for detecting the position of the top face of the sheets stacked on the sheet stacking plate, a cassette detection sensor, a driving device, and a controller. The sheet feed unit includes a first actuator for switching detection states of the first detection sensor and a second actuator for switching detection states of the second detection sensor. The controller determines the mounting state of the sheet feed unit based on the detection state of the first and second detection sensors.

6 Claims, 8 Drawing Sheets

(51) Int. Cl.
*B65H 1/26* (2006.01)
*B65H 7/20* (2006.01)

(52) U.S. Cl.
CPC .... *B65H 2553/612* (2013.01); *B65H 2553/80* (2013.01); *B65H 2801/06* (2013.01)

(56) References Cited

U.S. PATENT DOCUMENTS

2011/0158729 A1* 6/2011 Lee ..... G03G 15/6558 400/578
2013/0136517 A1* 5/2013 Hirose ..... B65H 3/0669 399/393
2014/0203496 A1* 7/2014 Hamasaki ..... B65H 1/266 271/18
2017/0217707 A1* 8/2017 Fujinuma ..... B65H 7/14

* cited by examiner

IMAGE FORMING APPARATUS COMPRISING A SHEET FEED UNIT REMOVABLY MOUNTED

INCORPORATION BY REFERENCE

This application is based upon and claims the benefit of priority from the corresponding Japanese Patent Applications Nos. 2015-231514 (Nov. 27, 2015) and 2016-199146 (Oct. 7, 2016), the entire contents of both of which are incorporated herein by reference.

BACKGROUND

The present disclosure relates to an image forming apparatus incorporating a sheet feed unit that is used to previously keep in stock a large number of sheets, such as paper sheets, to be supplied to a device.

Sheet feed cassettes are used, in image forming apparatuses exemplified by copiers and printers, for the feeding of cut paper sheets or the like. In a sheet feed cassette, a large number of unprinted sheets are kept in stock previously, and by a sheet feed unit provided near the sheet feed cassette, one sheet after another is separated and fed out from the topmost layer of the bunch of sheets stacked in the cassette.

The sheet feed unit is fitted with expendables such as a sheet feed roller and a pickup roller, and is thus configured to be easily mounted in and dismountable from the main body of the image forming apparatus on occasions of maintenance and replacement of those expendables.

Some sheet feed cassettes are provided with a sheet stacking plate on the top face of which sheets are stacked. The sheet stacking plate is supported, at its upstream-side end in the sheet feed direction, on the inner side of the bottom face of the cassette body, and is swingable, about this end as a pivot, at the downstream-side end in the sheet feed direction as a swinging end. The swinging end of the sheet stacking plate is raised up by a driving means such as a lift motor provided in the image forming apparatus. This permits the downstream-side end of the sheets stacked on the sheet stacking plate to move to a proper sheet feed position, enabling stable sheet feeding.

As a method for detecting the sheet feed position, it is common to read the output value of a sensor that detects the top face of the sheets or of the sheet stacking plate in a manner interlocked with the pickup roller arranged in the sheet feed unit. For example, a sheet feeding device is known which is provided with a first detection sensor for detecting whether or not a sheet has passed between a sheet feed roller pair and a second detection sensor (top-face detection sensor) for detecting the sheet feed position at which the sheet stacking plate is raised.

SUMMARY

According to one aspect of the present disclosure, an image forming apparatus includes an apparatus main body, a sheet storage cassette, a sheet feed unit, a first detection sensor, a second detection sensor, a cassette detection sensor, a driving device, and a controller. The sheet storage cassette is removably mounted in the apparatus main body, and includes a sheet storage portion in which sheets are stored, a sheet stacking plate of which an upstream-side end part in the sheet feed direction is pivotably supported on the bottom face or a side face of the sheet storage portion and on a top face of which the sheets are stacked, and a lift mechanism which raises and lowers the sheet stacking plate. The sheet feed unit is removably mounted in the apparatus main body, and feeds out the sheets stacked on the sheet stacking plate. The first detection sensor detects presence/absence of sheets stacked on the sheet stacking plate. The second detection sensor detects the top face of the sheets stacked on the sheet stacking plate raised by the lift mechanism. The cassette detection sensor detects the mounting of the sheet storage cassette. The driving device transmits a driving force to the lift mechanism. The controller controls the driving of the driving device. The sheet feed unit includes a first actuator which switches detection states of the first detection sensor according to the presence/absence of the sheets stacked on the sheet stacking plate and a second actuator which switches detection states of the second detection sensor according to the position of the sheet stacking plate or of the top face of the sheets stacked on the sheet stacking plate. The controller operates in the following manner: with the cassette detection sensor detecting the mounting of the sheet storage cassette, when the first detection sensor detects that the sheets are not stacked on the sheet stacking plate, the controller determines that the sheet feed unit is in a mounted state; when the first detection sensor detects that the sheets are stacked on the sheet stacking plate, the controller drives the driving device to make the lift mechanism raise the sheet stacking plate and, when the second detection sensor detects the top face of the sheets, the controller determines that the sheet feed unit is in the mounted state and, when the second detection sensor does not detect the top face of the sheets even after the driving device has been driven for a predetermined time, the controller determines that the sheet feed unit is in a dismounted state.

Further features and advantages of the present disclosure will become apparent from the description of embodiments given below.

DETAILED DESCRIPTION

Figure 1:
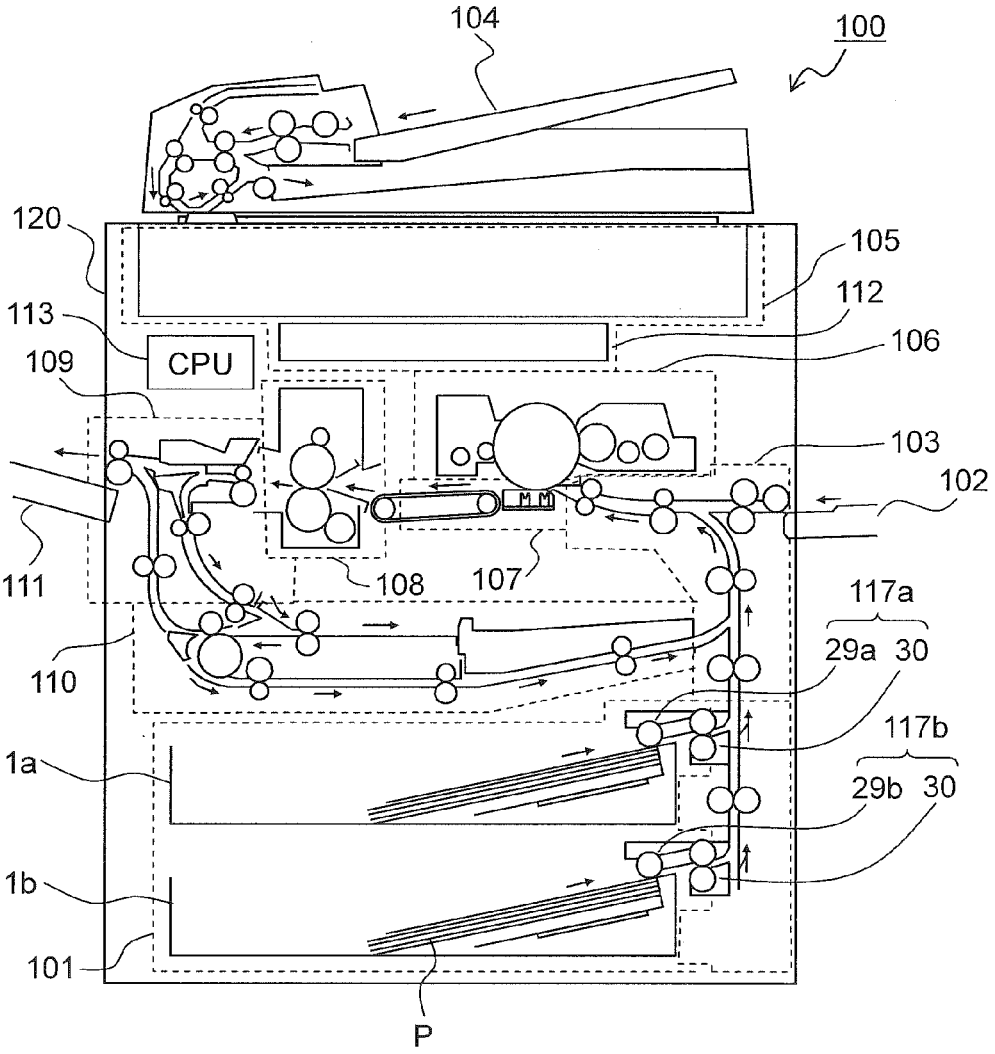
FIG. 1 is a side sectional view showing an internal structure of an image forming apparatus 100 according to one embodiment of the present disclosure.

Hereinafter, with reference to the accompanying drawings, an embodiment of the present disclosure will be described in detail. FIG. 1 is a side sectional view showing an internal structure of an image forming apparatus 100 according to one embodiment of the present disclosure. In the figure, solid-line arrows indicate transport paths and transport directions of sheets.

In FIG. 1, in a bottom part of the image forming apparatus 100, a cassette sheet feed section 101 is arranged. The cassette sheet feed section 101 is provided with two sheet feed cassettes 1*a* and 1*b*. Inside these sheet feed cassettes 1*a* and 1*b*, bundles of sheets P such as unprinted cut paper sheets are stored in stacks, and from the bundles of sheets P, one sheet after another is separated and fed out by sheet feed units 117*a* and 117*b* provided in an apparatus main body 120 of the image forming apparatus 100. The sheet feed unit 117*a* includes a pickup roller 29*a* and a sheet feed roller pair 30 that are provided to correspond to the sheet feed cassette 1*a*. The sheet feed unit 117*b* includes a pickup roller 29*b* and a sheet feed roller pair 30 that are provided to correspond to the sheet feed cassette 1*b*. The sheet feed units 117*a* and 117*b* are respectively provided with roller holders 31 (see FIG. 5) for rotatably holding the pickup roller 29*a*, the feed roller 30*a*, the pickup roller 29*b*, and the feed roller 30*b*.

A manual sheet feed section 102 is provided in an upper part of the right side face of the image forming apparatus 100, outside it. On the manual sheet feed section 102 are stacked sheets of a size or thickness different from those in the cassette sheet feed section 101, and sheets that are fed in one by one such as OHP sheets, envelopes, postcards, and transmittal forms.

Inside the image forming apparatus 100, a sheet transport section 103 is arranged. The sheet transport section 103 is located to the right of the cassette sheet feed section 101, that is, on the downstream side in the sheet feed direction, and to the left of the manual sheet feed section 102, that is, on the downstream side in the sheet feed direction. A sheet fed out from the cassette sheet feed section 101 is transported vertically upward along a side face of the apparatus main body 120 by the sheet transport section 103, and a sheet P fed out from the manual sheet feed section 102 is transported horizontally.

On the top face of the image forming apparatus 100, a document transport device 104 is arranged, and under it, an image reading section 105 is arranged. When a user copies a document, a plurality of document sheets carrying images such as text, graphics, and designs are stacked. The document transport device 104 feeds out document sheets one by one separately, and the image reading section 105 reads their image data.

On the downstream side of the sheet transport section 103 in the sheet transport direction, under the image reading section 105, an image forming section 106 and a transferring section 107 are arranged. In the image forming section 106, based on image data read by the image reading section 105, an electrostatic latent image of a document image is formed, and this electrostatic latent image is then developed to form a toner image. On the other hand, synchronously with the timing of the formation of the toner image in the image forming section 106, a sheet P is transported from the cassette sheet feed section 101 via the sheet transport section 103 to the transferring section 107. The toner image formed in the image forming section 106 is transferred to the sheet P in the transferring section 107.

On the downstream side of the transferring section 107, a fixing section 108 is arranged. The sheet P having an unfixed toner image transferred to it in the transferring section 107 is transported to the fixing section 108, where, as the sheet P passes through the nip portion between a fixing roller pair including a heating roller and a pressing roller, the unfixed toner image on the sheet P is fixed to become a permanent image.

On the downstream side of the fixing section 108, near the left side face of the image forming apparatus 100, a discharging/branching section 109 is arranged. The sheet discharged from the fixing section 108, when it is not subjected to duplex printing, is discharged from the discharging/branching section 109 onto a sheet discharge tray 111 provided on the left side face of the image forming apparatus 100, outside it.

Under the region spanning from the image forming section 106 to the discharging/branching section 109, over the cassette sheet feed section 101, a duplex printing unit 110 is arranged. When duplex printing is performed, a sheet discharged from the fixing section 108 is fed via the discharging/branching section 109 to the duplex printing unit 110. The sheet fed to the duplex printing unit 110 is switched back such that its obverse and reverse faces are reversed, and is then once again transported through the sheet transport section 103 to the transferring section 107, this time with that face of the sheet on which no image has yet been formed up.

In the image forming apparatus 100, there are also arranged an operation section (indicating device) 112 and a controller 113. The operation section 112 is provided with a liquid crystal display unit and LEDs so as to serve to indicate the status of the image forming apparatus 100 and to display the progress of image formation and the numbers of copies printed. The operation section 112 is further provided with a Start button, which the user operates to start image formation; a Stop/Clear button, which the user uses to stop image formation or for other purposes; a Reset button, which the user uses to recover default settings for various settings of the image forming apparatus 100. The controller 113 exchanges control signals and/or input signals with different devices within the image forming apparatus 100.

Figure 2:
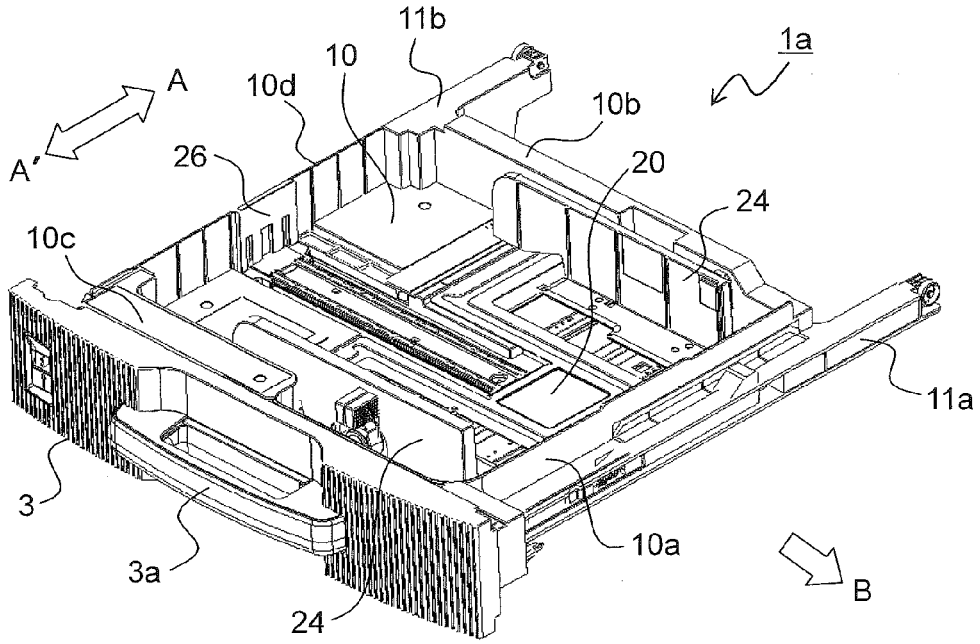
FIG. 2 is a perspective view, as seen from the front-face side, of a sheet feed cassette 1*a* in the image forming apparatus 100 according to the embodiment.
Figure 3:
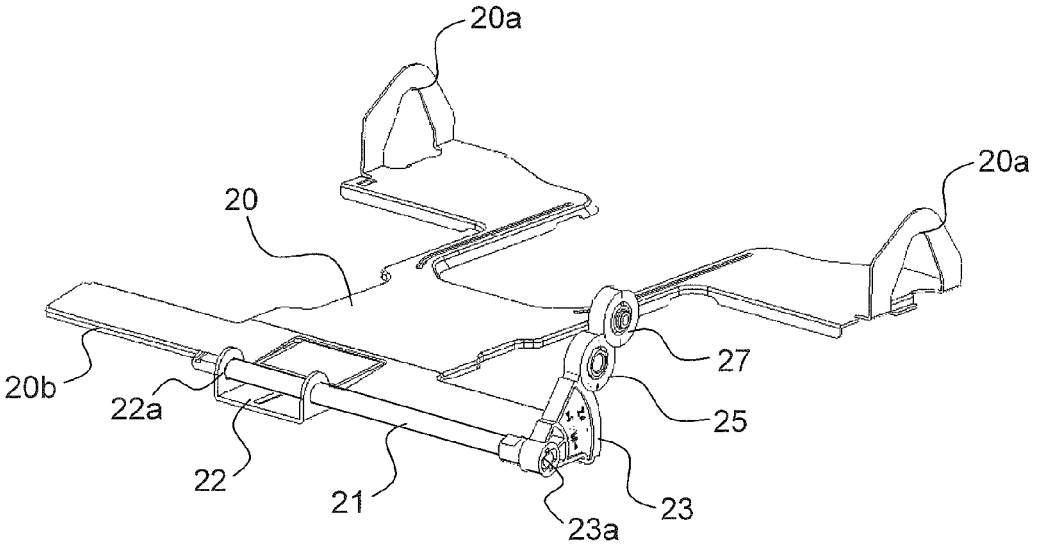
FIG. 3 is a perspective view showing a raising/lowering mechanism of a sheet stacking plate 20 used for the sheet feed cassette 1*a*, showing a state where a free end 20*b* of the sheet stacking plate 20 is lowered down to its lowest level.

Next, a specific structure of the sheet feed cassette 1*a*, which is removably mounted in the image forming apparatus 100, will be described in detail with reference to, in addition the FIG. 1, FIGS. 2 and 3. FIG. 2 is an exterior perspective view of the sheet feed cassette 1*a* as it is seen from the upper front-face side, and FIG. 3 is a perspective view showing a raising/lowering mechanism of a sheet stacking plate 20 used in the sheet feed cassette 1*a*. While a structure of the sheet feed cassette 1*a* will be discussed below, the sheet feed cassette 1*b* has quite the same structure.

In FIG. 2, the sheet feed cassette 1*a* is designed to be mounted in the cassette sheet feed section 101 in the image forming apparatus 100 shown in FIG. 1. A cassette body 10 is configured in the shape of a flat box that has walls 10*a* to 10*d* erect from four peripheral edges of the bottom face so as to open at the top face, and stores a bundle of sheets P (see FIG. 1) stacked from the top-face direction. Inside the image forming apparatus 100, over the sheet feed cassette 1*a*, outside the wall 10*a* that is located on the downstream side of the cassette body 10 in the sheet transport direction, the sheet feed unit 117*a* (see FIG. 1) is arranged, and from the bundle of sheets P, one sheet after another is separated and fed out in the direction indicated by arrow B in FIG. 2. In a front-face part of the cassette body 10, an exterior cover 3 is formed integrally, and this exterior cover 3 forms part of a housing in a bottom part of the front face of the image forming apparatus 100. In a central part of the exterior cover 3, a handle 3*a* is provided which is held when the sheet feed cassette 1*a* is mounted and dismounted.

Outside the walls 10*a* and 10*d* that are parallel to the insertion/extraction direction (the direction indicated by arrows AA') of the sheet feed cassette 1*a*, guide rails 11*a* and 11*b* are fitted. In the apparatus main body 120 of the image forming apparatus 100, a pair of rail supports 44*a* (see FIG. 7) are provided which slidably support the guide rails 11*a* and 11*b*. As the guide rails 11*a* and 11*b* are slid along the rail supports 44*a*, the sheet feed cassette 1*a* can be mounted in and dismounted from the image forming apparatus 100.

On the inner side of the bottom face of the cassette body 10, the sheet stacking plate 20 is provided. The bundle of sheets P is stacked on the sheet stacking plate 20. The sheet stacking plate 20 and the raising/lowering mechanism of the sheet stacking plate 20 will be described later.

Inside the cassette body 10, a pair of width restricting cursors 24 is provided erect along the sheet feed direction (the direction indicated by arrow B). The width restricting cursors 24 abut on side faces of the bundle of sheets P from opposite sides in the sheet width direction, which is perpendicular to the sheet feed direction, and position the bundle of sheets P in the width direction such that the bundle of sheets P is located in a sheet feed position from which the sheets are fed out by the sheet feed unit 117*a*. The width restricting cursors 24 are movable along cursor movement grooves (unillustrated) which are provided in the inner side of the bottom face of the cassette body 10 and which extend in the sheet width direction. The pair of width restricting cursors 24, which abuts on side faces of the bundle of sheets P from opposite sides in the sheet width direction, are interlocked by an unillustrated interlocking mechanism provided under them such that, as one is moved, the other too moves. Here, the pair of width restricting cursors 24 moves symmetrically in the left/right direction about the width-direction center line of the bundle of sheets P.

Inside the cassette body 10, on the upstream side in the sheet feed direction, a tail-end restricting cursor 26 is provided. The tail-end restricting cursor 26 abuts on a side face of the bundle of sheets P from the upstream side in the sheet feed direction, and positions the bundle of sheets P in the sheet feed direction such that the bundle of sheets P is located in a sheet feed position from which, out of the bundle of sheets P, one sheet after another is separated and fed out by the sheet feed unit 117*a*. The tail-end restricting cursor 26 is movable along a cursor movement groove (unillustrated) which is provided in the inner side of the bottom face of the cassette body 10 and which extends along the sheet feed direction.

As shown in FIG. 3, the sheet stacking plate 20 is supported on the inner side of the bottom face of the cassette body 10 with an end part of the sheet stacking plate 20 on the upstream side in the sheet feed direction serving as a swing pivot 20*a*, and is swingable up and down with an end part on the downstream side of the sheet feed direction serving as a free end 20*b*. The sheet stacking plate 20 is a plate-form member, and has cuts formed in the movement regions of the width restricting cursors 24 and the tail-end restricting cursor 26.

Under near the free end 20*b* of the sheet stacking plate 20, an action plate driving shaft 21 is arranged. The action plate driving shaft 21 is rotatably held on a bearing (unillustrated) which is formed in the inner side of the bottom face of the cassette body 10. One end of the action plate driving shaft 21 penetrates through a fastening hole 22*a* in an action plate 22, and thereby the action plate driving shaft 21 and the action plate 22 are fastened together. The action plate 22 is arranged at a position opposite an approximately central part of the reverse face of the sheet stacking plate 20 in the sheet width direction.

The other end of the action plate driving shaft 21 is coupled to a fan-shaped gear 23. The fan-shaped gear 23 is coupled via an idle gear 25 to a drive input coupling 27. As shown in FIG. 2, part of the drive input coupling 27 is exposed out of the cassette body 10, and when the sheet feed cassette 1*a* is inserted in the image forming apparatus 100, the drive input coupling 27 is coupled with a drive output coupling 37 (see FIG. 6) of a lift motor 35*a* which is provided in the apparatus main body 120.

FIG. 3 shows a state where the sheet feed cassette 1*a* is not inserted in the image forming apparatus 100 and the drive input coupling 27 is not coupled with the drive output coupling 37 in the apparatus main body 120. In this state, the action plate 22 is arranged in a position in which it lies flat along the bottom face of the cassette body 10. Accordingly, the free end 20*b* of the sheet stacking plate 20 is lowered down to its lowest level.

Figure 4:
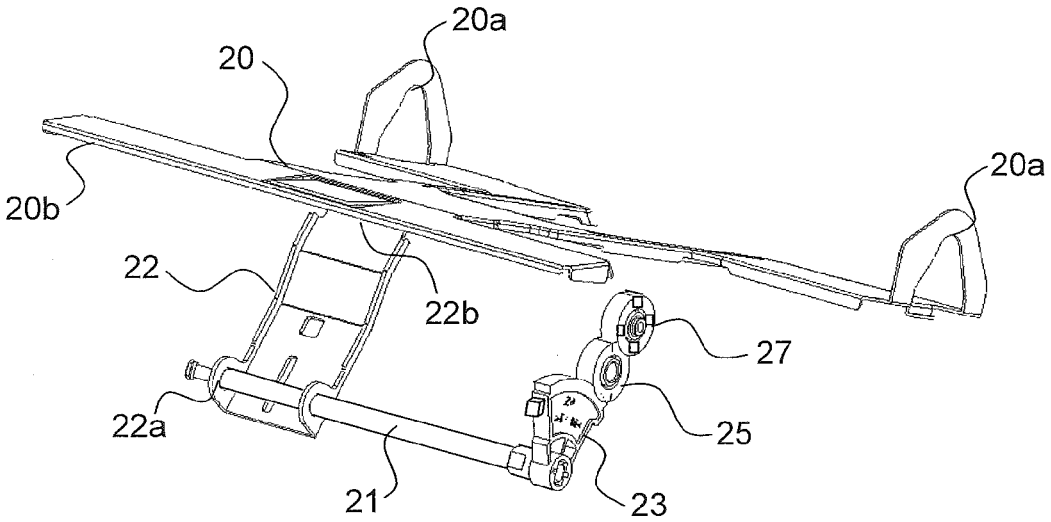
FIG. 4 is a perspective view showing the raising/lowering mechanism of the sheet stacking plate 20, showing a state where the free end 20*b* of the sheet stacking plate 20 is raised by an action plate 22.
Figure 5:
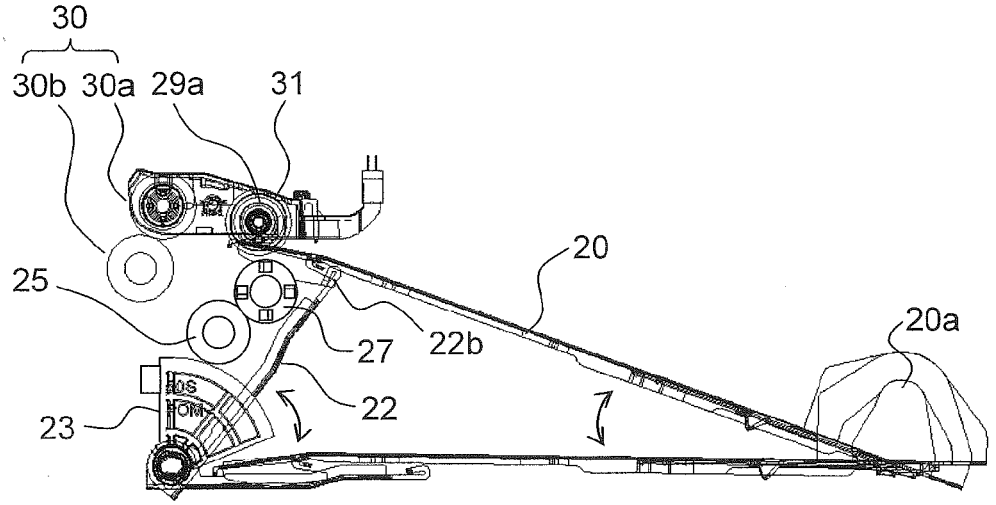
FIG. 5 is a side view showing the raising/lowering mechanism of the sheet stacking plate 20, showing the state where the free end 20*b* of the sheet stacking plate 20 is raised by the action plate 22.

FIGS. 4 and 5 are a perspective view and a sectional view, respectively, showing the raising/lowering mechanism of the sheet stacking plate 20, showing a state where the free end 20*b* of the sheet stacking plate 20 is raised by the action plate 22. With the sheet feed cassette 1*a* inserted in the image forming apparatus 100, as the drive output coupling 37 rotates, a driving force is transmitted to the action plate driving shaft 21 via the drive input coupling 27, the idle gear 25, and the fan-shaped gear 23. As the action plate 22 swings in the counter-clockwise direction in FIG. 5, a swing-side end edge 22*b* of the action plate 22 slides along the reverse face of the sheet stacking plate 20, and the free end 20*b* of the sheet stacking plate 20 is raised to move up. The action plate driving shaft 21, the action plate 22, the fan-shaped gear 23, the idle gear 25, and the drive input coupling 27 constitute a lift mechanism which raises and lowers the sheet stacking plate 20.

As a result, the topmost layer of the bundle of sheets P stacked on the sheet stacking plate 20 makes contact with the pickup roller 29, and by a sheet feed roller pair 30 including a feed roller 30*a* and a retard roller 30*b*, one sheet after another is separated and fed out from the sheet feed cassette 1*a* to the sheet transport section 103 (see FIG. 1).

As more of the sheets stacked on the sheet stacking plate 20 are fed out, the amount of rotation of the drive input coupling 27 increases, thus the amount of swing of the action plate 22 increases, and thus the angle between the bottom face of the cassette body 10 and the action plate 22 increases. When all the sheets stacked on the sheet stacking plate 20 have been fed out, the action plate 22 is arranged at a position in which it is raised by a predetermined angle from the bottom face of the cassette body 10, and the free end 20*b* of the sheet stacking plate 20 is raised up to its highest level.

Figure 6:
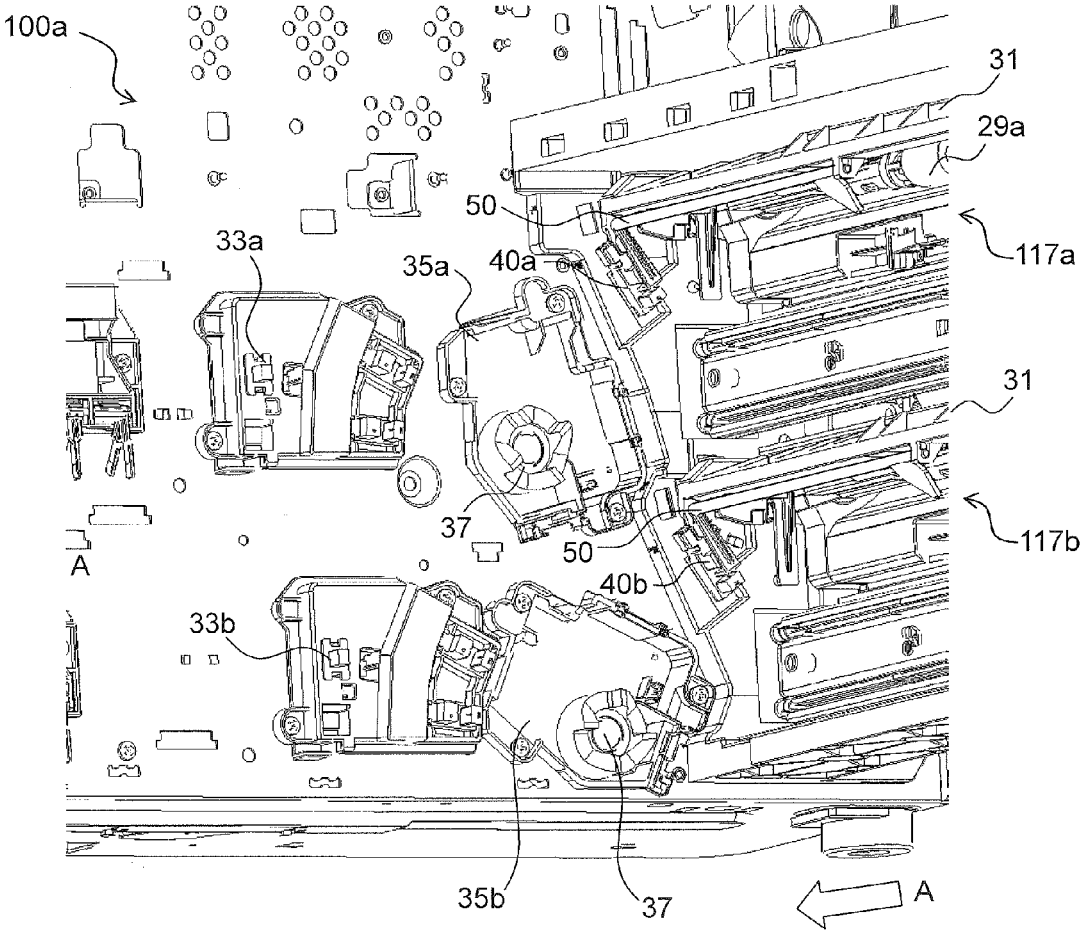
FIG. 6 is a partial perspective view of the downstream side, in the sheet feed direction, of a unit insertion section 100*c* in the apparatus main body 120, showing a state where sheet feed units 117*a* and 117*b* are inserted in the unit insertion section 100*c;*
Figure 7:
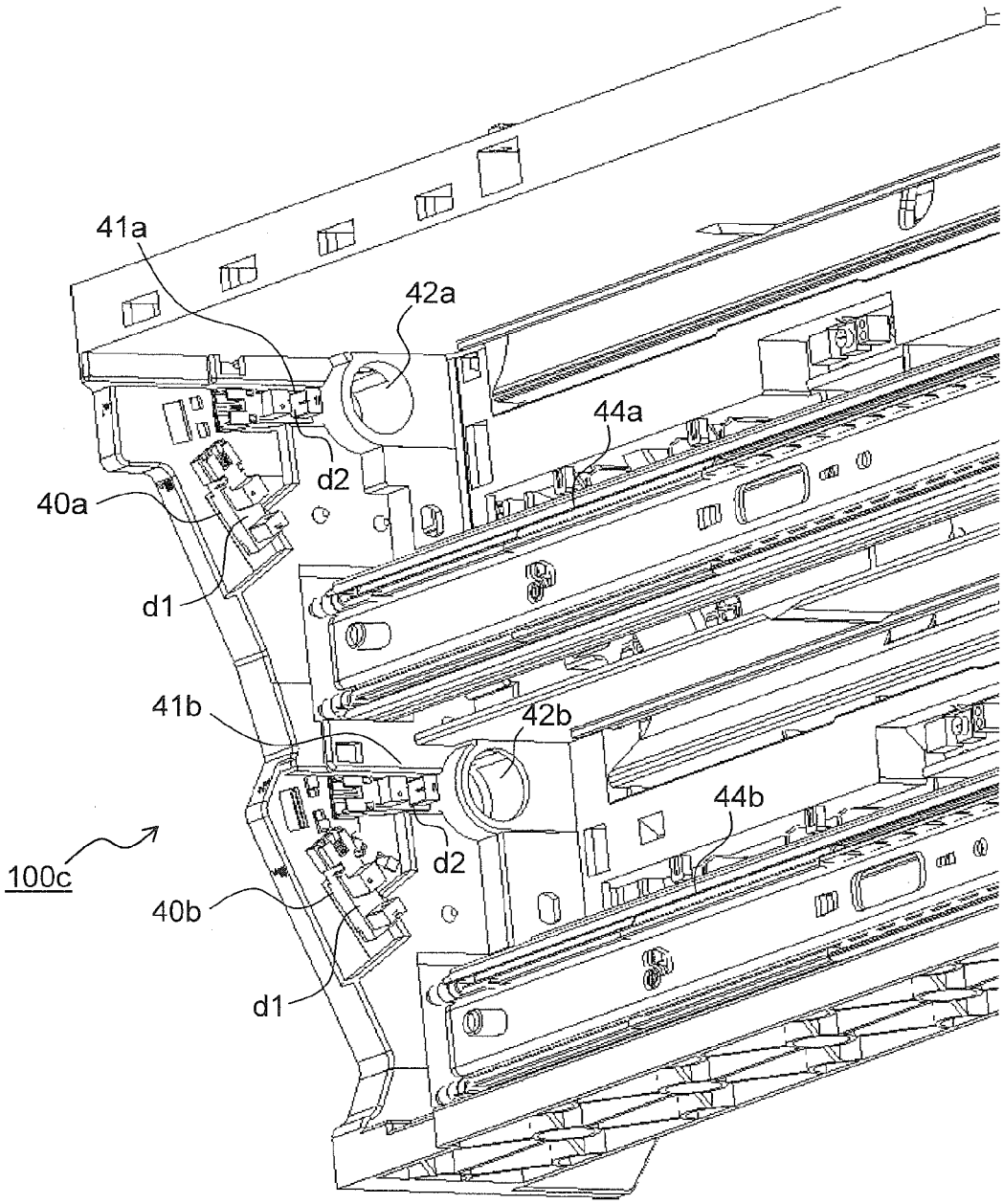
FIG. 7 is a partial perspective view of the downstream side, in the sheet feed direction, of the unit insertion section 100*c* in the apparatus main body 120, showing a state where sheet feed units 117*a* and 117*b* are removed from the unit insertion section 100*c;*
Figure 8:
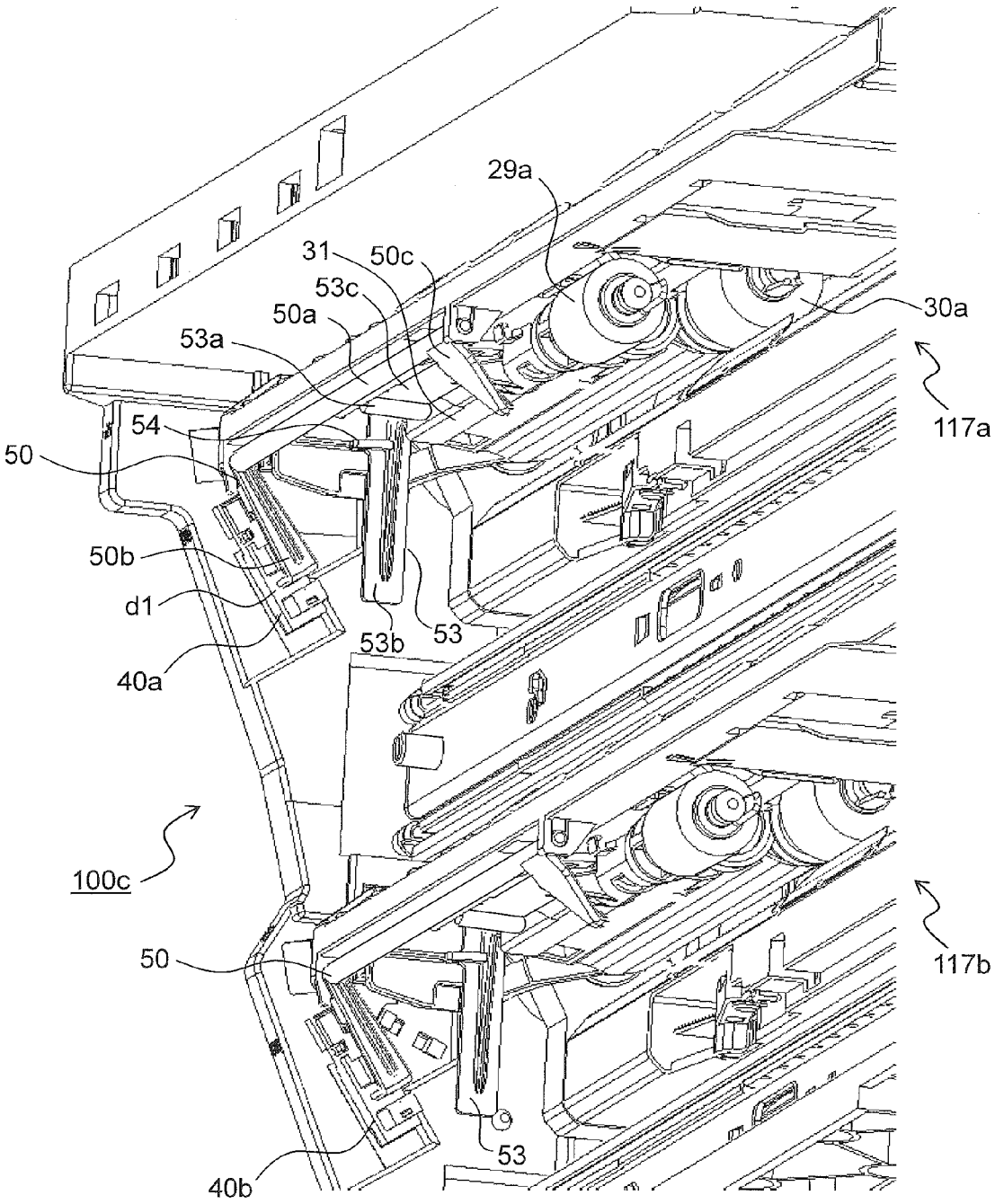
FIG. 8 is a partial perspective view near a PE detection sensor 40*b* in a sheet feed unit 117*a;*
Figure 9:
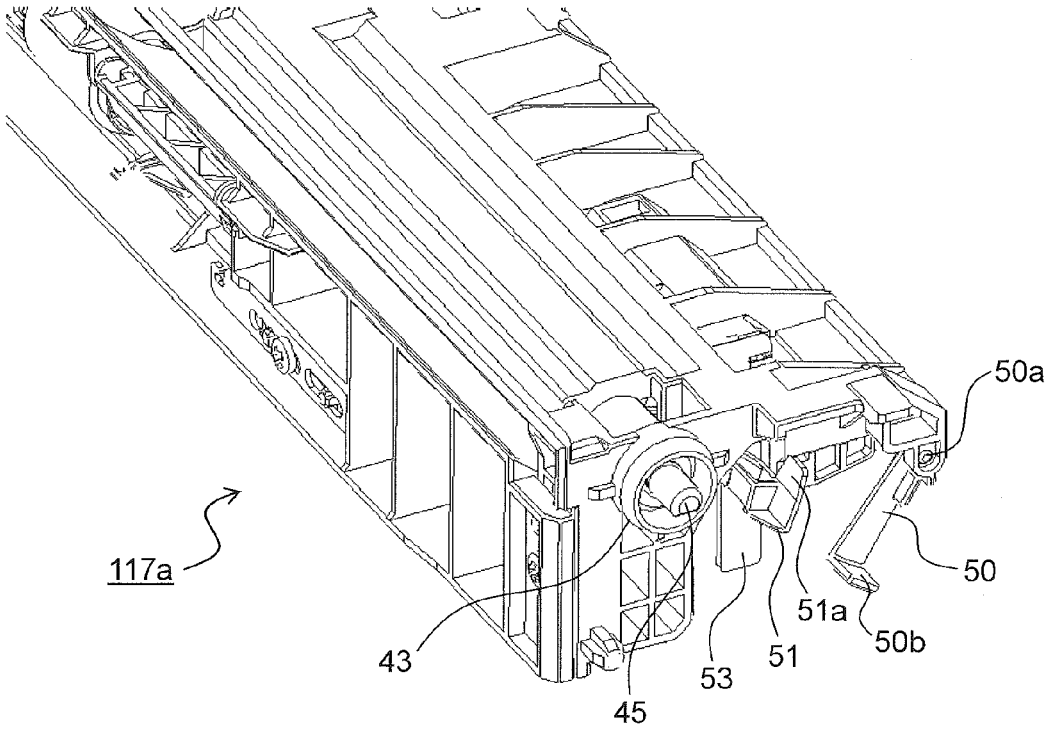
FIG. 9 is a partial perspective view showing a structure of one-end side (the far side in FIG. 1) of the sheet feed unit 117*a*.

FIGS. 6 and 7 are perspective views of a downstream-side part, in the insertion direction, of a unit insertion section 100*c* in the apparatus main body 120, FIG. 6 showing a state where the sheet feed units 117*a* and 117*b* are inserted in the unit insertion section 100*c*, FIG. 7 showing a state where the sheet feed units 117*a* and 117*b* are removed from the unit insertion section 100*c*. FIG. 8 is a partial perspective view around a PE detection sensor 40*b* in the sheet feed unit 117*a* in FIG. 6, and FIG. 9 is a partial perspective view showing a structure of the sheet feed unit 117*a* on one end side thereof (the far side in FIG. 1). The sheet feed unit 117*b* has quite the same structure as the sheet feed unit 117*a* shown in FIG. 9.

As shown in FIG. 6, the sheet feed units 117*a* and 117*b* are supported, in a mountable/dismountable fashion, in the unit insertion section 100*c*, which is formed between a pair of side-face frames 100*a* and 100*b* (in FIG. 6, the front-face-side side-face frame 100*b* is unillustrated) that are arranged opposite each other on the rear-face and front-face sides of the image forming apparatus 100.

In the unit insertion section 100*c*, on the side-face frame 100*c* on the downstream side in the insertion direction of the sheet feed cassettes 1*a* and 1*b* (the direction indicated by arrow A in FIG. 6), there are arranged cassette detection sensors 33*a* and 33*b* and lift motors 35*a* and 35*b*. The bodies of the lift motors 35*a* and 35*b* are fastened on the reverse-face side of the side-face frame 100*a*, and the drive output coupling 37, which is fastened to the rotary shafts of the lift motors 35*a* and 35*b* and which meshes with the drive input coupling 27 (see FIG. 4) in the sheet feed cassettes 1*a* and 1*b*, are exposed into the unit insertion section 100*c*.

With the power to the image forming apparatus 100 on, when the sheet feed cassettes 1*a* and 1*b* are inserted up to predetermined positions inside the unit insertion section 100*c*, the cassette detection sensors 33*a* and 33*b* turn on, detecting the insertion of the sheet feed cassettes 1*a* and 1*b*. Moreover, the drive input coupling 27 meshes with the drive output coupling 37 of the lift motors 35*a* and 35*b*, permitting a driving force to be transmitted to the action plate driving shaft 21 via the drive input coupling 27, the idle gear 25, and the fan-shaped gear 23 (for all of these, see FIG. 4).

As shown in FIG. 7, in the unit insertion section 100*c*, there are arranged PE detection sensors (paper empty sensors) 40*a* and 40*b* for detecting the presence/absence of the sheets in the sheet feed cassettes 1*a* and 1*b* and top-face detection sensors 41*a* and 41*b* for detecting the top face of the bundle of sheets P inside the sheet feed cassettes 1*a* and 1*b*. The PE detection sensors 40*a* and 40*b* and the top-face detection sensors 41*a* and 41*b* are PI (photointerruptor) sensors that have a detector, including a light emitter and a light receiver, provided on opposite inner faces of a U-shape as seen in a plan view. The detector of the PE detection sensors 40*a* and 40*b* is called a first detector d1, and the detector of the top-face detection sensors 41*a* and 41*b* is called a second detector d2.

Moreover, in the unit insertion section 100*c*, there are formed a pair of rail supports 44*a* and 44*b* for slidably supporting the guide rails 11*a* and 11*b* for the sheet feed cassettes 1*a* and 1*b* and bearing holes for supporting a boss 43 of the sheet feed units 117*a* and 117*b* (a rotary shaft 45 of the feed roller 30*a*; see FIG. 9). FIG. 7 only shows the rail supports 44*a* and 44*b* on one side which support the guide rails 11*a* and 11*b*.

As shown in FIG. 8, a PE detection actuator (first actuator) 50 has a shaft 50*a* which extends from the far side of the sheet feed units 117*a* and 117*b* to a central part thereof and which is rotatably supported, a first light-shielding plate 50*b* which is formed at one end, i.e., the far-side end, of the shaft 50*a* (outside the sheet passage region) and which shuts off or opens up the optical path of the first detector d1 of the PE detection sensor 40*a*, and a contact piece 50*c* which is formed at the other end, i.e., the central-part-side end, of the shaft 50*a* (near the feed roller 30*a*) and which makes contact with the bundle of sheets P inside the sheet feed cassette 1*a*. FIG. 8 shows a state where the sheet feed cassette 1*a* is not inserted, in which state the optical path of the first detector d1 of the PE detection sensor 40*a* is shut off by the first light-shielding plate 50*b*, so that the received signal level of the first detector d1 is in a LOW state.

After the sheet feed cassette 1*a* having a bundle of sheets P stacked on the sheet stacking plate 20 is inserted, when the sheet stacking plate 20 is raised by a predetermined amount, the contact piece 50*c* is pressed by the bundle of sheets P and the PE detection actuator 50 pivots, so that the first light-shielding plate 50*b* swings in the counter-clockwise direction in FIG. 8. As a result, the first light-shielding plate 50*b* retracts away from the first detector d1 and opens up the optical path of the first detector d1. Thus, the received signal level of the first detector d1 turns from LOW to HIGH.

In the sheet stacking plate 20, a slit (unillustrated) is formed through which the contact piece 50*c* of the PE detection actuator 50 can pass. As printing operation proceeds and the sheets inside the sheet feed cassette 1*a* decreases, the sheet stacking plate 20 rises accordingly, so that the angle of the PE detection actuator 50 is kept constant. When the sheets inside the sheet feed cassette 1*a* are exhausted, the contact piece 50*c* passes through the slit in the sheet stacking plate 20, and the PE detection actuator 50 swing in the clockwise direction into the state shown in FIG. 8. As a result, the first light-shielding plate 50*b* shuts off the optical path of the first detector d1, and the received signal level of the first detector d1 turns back to LOW, enabling detection of absence of sheets inside the sheet feed cassette 1*a*. While the description thus far deals with detection of sheets by the PE detection sensor 40*a* and the PE detection actuator 50 corresponding to the sheet feed cassette 1*a*, detection of sheets by the PE detection sensor 40*b* and the PE detection actuator 50 corresponding to the sheet feed cassette 1*b* proceeds in quite the same way.

On the sheet feed unit 117*a*, a roller holder 31 (see FIG. 8) is supported so as to be pivotable about a rotary shaft 45 of the sheet feed roller 30*a* as a pivot. The rotary shaft 45 is inserted in a bearing hole 42*a* (see FIG. 7) in the unit insertion section 100*c*. Outside the rotary shaft 45 in the radial direction, a boss 43 for positioning is formed.

On the roller holder 31, a top-face detection actuator (second actuator) 51 is arranged. The top-face detection actuator 51 has a second light-shielding plate 51*a* which shuts off or opens up the optical path of the second detector d2 (see FIG. 7) of the top-face detection sensor 41*a*. When no sheet transport is taking place, during which time the sheet stacking plate 20 is not raised, the second light-shielding plate 51*a* is retracted away from, below, the second detector d2 of the top-face detection sensor 41*a*, and the received signal level of the detector is in a HIGH state.

When sheet transport is taking place, as the action plate 22 (see FIG. 4) swings and the free end of the sheet stacking plate 20 rises, the top face of the bundle of sheets P stacked on the sheet stacking plate 20 (when no bundle of sheets P is stacked, the sheet stacking plate 20) makes contact with the pickup roller 29, the pickup roller 29 is pushed up together with the roller holder 31, and the top-face detection actuator 51 supported on the roller holder 31 swings upward. As a result, the second light-shielding plate 51*a* of the top-face detection actuator 51 shuts off the optical path of the second detector d2, and the received signal level of the second detector d2 turns from HIGH to LOW, enabling detection of the height of the pickup roller 29, that is, the top face position of the bundle of sheets P.

Moreover, on the sheet feed unit 117*a*, a holder support member 53 is provided so as to be swingable about a pivot 53*a* (see FIG. 8). The holder support member 53 is substantially L-shaped, including a base shaft 53*a*, a contact piece 53*b*, and a support piece 53*c*. The base shaft 53*a* is arranged so as to be perpendicular to the insertion direction of the sheet feed unit 117*a*. The contact piece 53*b* extends downward from the base shaft 53*a*, and is pressed by the wall 10*b* (see FIG. 2) when the sheet feed unit 117*a* is mounted in the unit insertion section 100*c*. The base shaft 53*a* is fitted with a torsion spring (unillustrated), and the holder support member 53 is biased in the near-side direction with respect to the plane of FIG. 9. Furthermore, there is provided a stopper 54 which extends parallel to the base shaft 53*a* under the base shaft 53*a* and which restricts the rotation of the contact piece 53*b* from the upstream side in the insertion direction of the sheet feed unit 117*a*. With the sheet feed cassette 1*a* not inserted, the holder support member 53 is located at the position shown in FIG. 9 by the biasing force of the torsion spring, and holds the roller holder 31 in a state raised up. In this way, when the sheet feed cassette 1*a* is inserted in the unit insertion section 100*c*, interference between the cassette body 10 and the pickup roller 29 is avoided.

When the sheet feed cassette 1*a* is inserted up to a predetermined position in the unit insertion section 100*c*, the wall 10*b* (see FIG. 2) on the downstream side in the insertion direction presses the holder support member 53, and the holder support member 53 swings in the far-side direction with respect to the plane of FIG. 9 against the biasing force of the torsion spring. As a result, the roller holder 31 moves down under its own weight and makes contact with the top face of the bundle of sheets P.

Next, a description will be given of an insertion detection mechanism for the sheet feed unit 117*a* in the image forming apparatus 100 according to the present disclosure. With the sheet feed unit 117*a* inserted, when the sheet feed cassette 1*a* is inserted with no bundle of sheets P stacked on the sheet stacking plate 20, the contact piece 50*c* of the PE detection actuator 50 is not pressed by the bundle of sheets P, and thus the first detector d1 of the PE detection sensor 40*a* is in a light-shielded state. In contrast, when the sheet feed cassette 1*a* is inserted with a bundle of sheets P stacked on the sheet stacking plate 20, the contact piece 50*c* of the PE detection actuator 50 is pressed by the bundle of sheets P, and the first detector d1 of the PE detection sensor 40*a* is in a light-transmitted state.

On the other hand, with the sheet feed unit 117*a* not inserted, when the sheet feed cassette 1*a* is inserted, because of the absence of the PE detection actuator 50, the first detector d1 of the PE detection sensor 40*a* is in a light-transmitted stated. Accordingly, when the sheet feed cassette 1*a* is inserted with a bundle of sheets P stacked on the sheet stacking plate 20, it is not possible to determine whether or not the sheet feed unit 117*a* is inserted based only on the detection result of the PE detection sensor 40*a*.

Here, when the sheet feed unit 117*a* is inserted and in addition a bundle of sheets P is stacked on the sheet stacking plate 20 in the sheet feed cassette 1*a*, swinging the action plate 22 by a predetermined amount and raising the sheet stacking plate 20 a little causes the pickup roller 29*a* to be pushed up together with the roller holder 31 by the bundle of sheets P. As a result, The second light-shielding plate 51*a* of the top-face detection actuator 51 shuts off the optical path of the second detector d2 of the top-face detection sensor 41*a* and changes the received signal level, enabling detection of the top face of the bundle of sheets P. At the time point that the top face of the bundle of sheets P is detected, the lift motor 35*a* can be stopped.

In contrast, when the sheet feed unit 117*a* is not inserted, because of the absence of the top-face detection actuator 51, even when the action plate 22 is swung and the sheet stacking plate 20 is raised, the received signal level of the second detector d2 of the top-face detection sensor 41*a* does not change. Thus, when swinging the action plate 22 by a predetermined amount (for a predetermined time) does not change the received signal level of the second detector d2, the controller 113 can determine that the sheet feed unit 117*a* is not inserted and stop the lift motor 35*a*. In a case where, because of a failure of the lift motor 35*a*, the action plate 22 does not swing and the sheet stacking plate 20 does not rise, it is possible, by displaying on the operation section 112 (see FIG. 1) an indication to the effect that the lift motor 35*a* is failing, to distinguish the state from the state where the sheet feed unit 117*a* is not inserted. In this way, by use of the PE detection sensor 40*a* and the top-face detection sensor 41*a*, it is possible to reliably determine, when the sheet feed cassette 1*a* is inserted, whether or not the sheet feed unit 117*a* is inserted.

Figure 10:
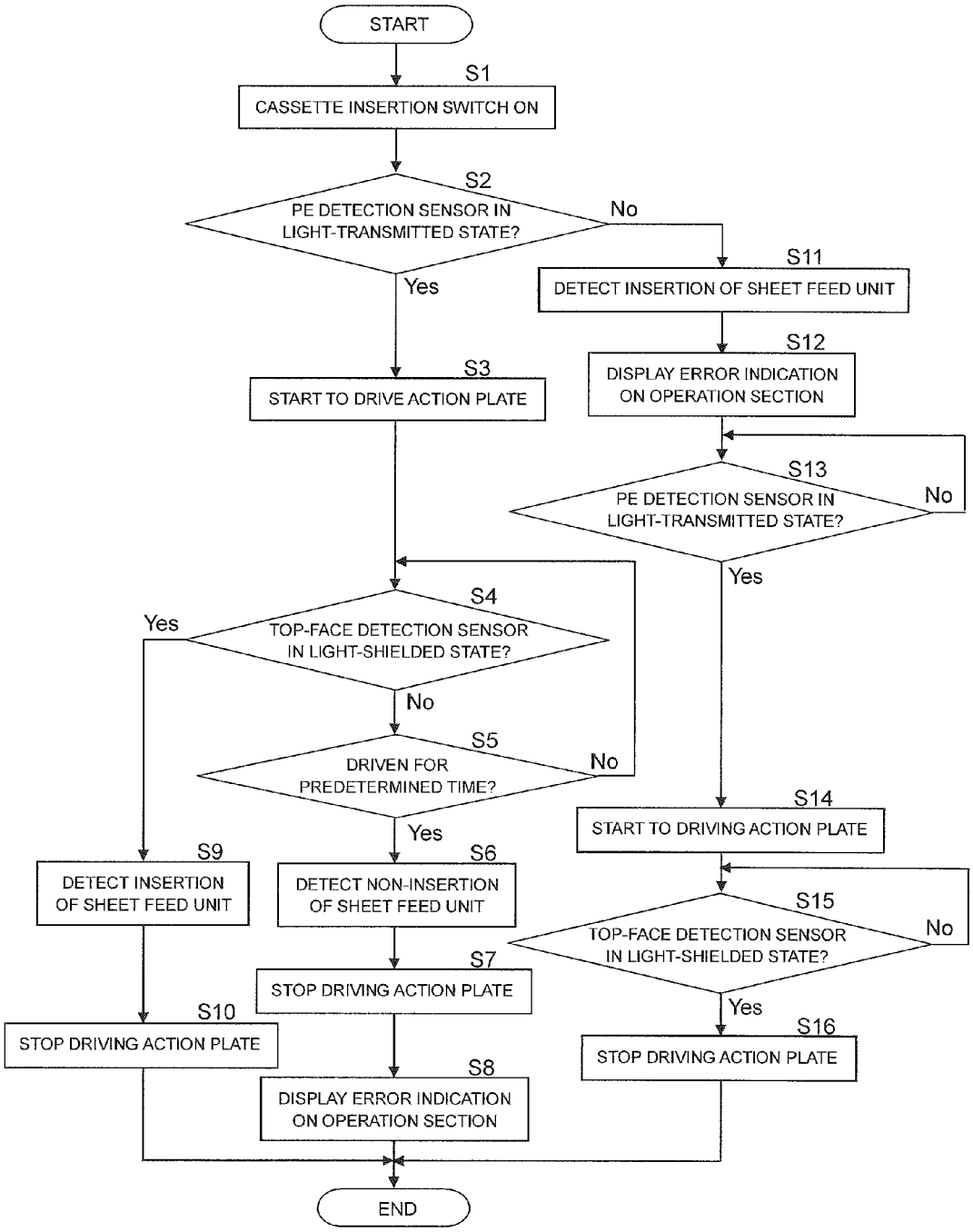
FIG. 10 is a flow chart showing control for detecting insertion of the sheet feed unit 117*a* in the image forming apparatus 100 according to the embodiment.

FIG. 10 is a flow chart showing control for detecting insertion of the sheet feed unit 117*a* in the image forming apparatus 100 according to the embodiment. Along the steps shown in FIG. 10, with reference also to FIGS. 1 to 9 as necessary, a description will now be given of a procedure for detecting insertion of the sheet feed unit 117*a*. While the following description deals with a procedure for detecting insertion of the sheet feed unit 117*a*, a procedure for detecting insertion of the sheet feed unit 117*b* is quite the same, and therefore no overlapping description will be repeated.

First, with the power to the image forming apparatus 100 on, when the sheet feed cassette 1*a* is inserted into the image forming apparatus 100, the cassette detection sensor 33*a* turns on (Step S1), and a detection signal is transmitted from the cassette detection sensor 33*a* to the controller 113, so that insertion of the sheet feed cassette 1*a* is detected. Next, the controller 113 checks whether or not the first detector d1 of the PE detection sensor 40*a* is in a light-transmitted state (Step S2).

When the first detector d1 of the PE detection sensor 40*a* is in a light-transmitted state (Step S2, YES), then, as mentioned earlier, it is unclear whether or not the sheet feed unit 117*a* is inserted, and thus a control signal is transmitted from the controller 113 to the lift motor 35*a* to start to drive the action plate 22 (Step S3). Then, it is checked whether or not the second detector d2 of the top-face detection sensor 41*a* goes into a light-shielded state (Step S4).

When the second detector d2 of the top-face detection sensor 41*a* is in a light-transmitted state (Step S4, NO), then the action plate 22 continues to be driven, and it is checked whether or not the action plate 22 has been driven for a predetermined time (Step S5). The "predetermined time" at Step S5 is set to be a short time that is sufficient to detect the top face of the bundle of sheets P when the sheet feed unit 117*a* is inserted. When the driving of the action plate 22 has not reached the predetermined time (Step S5, NO), the flow returns to Step S4, where the check of whether or not the second detector d2 has gone into a light-transmitted state is continued.

When, at Step S5, the driving of the action plate 22 has reached the predetermined time (Step S5, YES), it is determined that the sheet feed unit 117*a* is not inserted (Step S6), and the driving of the action plate 22 is ended (Step S7). Moreover, an error indication (e.g., a text message such as "Sheet feed unit not inserted") is indicated on the liquid crystal display unit in the operation section 112 to prompt insertion of the sheet feed unit 117*a* (Step S8).

When, at Step S4, the second detector d2 of the top-face detection sensor 41*a* has gone into a light-shielded state (Step S4, YES), it can be detected that the sheet feed unit 117*a* is inserted (Step S9), and thus, at the time point that the second detector d2 goes into a light-shielded state, the driving of the action plate 22 is ended (Step S10), and the process is ended.

On the other hand, when, at Step S2, the first detector d1 of the PE detection sensor 40*a* is in a light-shielded state (Step S2, NO), it can be detected that the sheet feed unit 117*a* is inserted (Step S11). In this case, that is, in a state where no bundle of sheets P is stacked on the sheet stacking plate 20, an Empty indication (e.g., a text message such as "No sheets available") is displayed on the liquid crystal display unit in the operation section 112 to prompt replenishing with a bundle of sheets P (Step S12).

Next, the controller 113 checks whether or not the first detector d1 of the top-face detection sensor 41*a* has gone into a light-transmitted state (Step S13). When the first detector d1 is in a light-transmitted state (Step S13, YES), the sheet feed cassette 1*a* has been replenished with a bundle of sheets P, and thus a control signal is transmitted from the controller 113 to the lift motor 35*a* to start to drive the action plate 22 (Step S14). Then, it is checked whether or not the second detector d2 of the top-face detection sensor 41*a* goes into a light-shielded state (Step S15), and at the time point that the second detector d2 goes into a light-shielded state, the driving of the action plate 22 is ended (Step S16), and the process is ended.

With the procedure described above, irrespective of the stacking condition of the bundle of sheets P in the sheet feed cassette 1*a*, it is possible to reliably check whether or not the sheet feed unit 117*a* is inserted in the image forming apparatus 100, and it is possible, when the sheet feed unit 117*a* is not inserted, to prevent the lift motor 35*a* from continuing to operate with the sheet stacking plate 20 raised up to its upper limit. It is thus possible to prevent the action plate driving shaft 21, the action plate 22, and the lift motor 35*a* from breaking under an excessive load.

Moreover, whether or not the sheet feed unit 117*a* is inserted is checked by use of the PE detection sensor 40*a*, which detects presence/absence of sheets, and the top-face detection sensor 41*a*, which detects the top-face position of sheets, and this eliminates the need to provide a sensor dedicated to discriminating the insertion state of the sheet feed unit 117*a*, contributing to a simplified control mechanism and reduced cost.

The present disclosure is not limited by the embodiment described above and allows for many modifications without departing from the spirit of the present disclosure. For example, although in the embodiment described above, transmissive sensors having a light emitter and a light receiver on opposite inner faces of a U-shape as seen in a plan view is used as the PE detection sensors 40*a* and 40*b* and the top-face detection sensors 41*a* and 41*b*, it is also possible to use reflective sensors in which light is emitted from a light emitter toward a reflector plate and the light reflected from the reflector plate is received by a light receiver.

Although in the embodiment described above, text messages are displayed on the liquid crystal display unit in the operation section 112 to indicate that the sheet feed units 117*a* and 117*b* are not mounted and that there is no bundle of sheets P in the sheet feed cassettes 1*a* and 1*b*, it is also possible to previously store audible messages instead of text messages to give indications by means of audible messages.

The sheet feed cassettes 1*a* and 1*b* can store not only sheets of paper but also various kinds of sheets such as OHP sheets and label sheets.

The present disclosure is applicable to image forming apparatuses provided with a sheet feed unit and a sheet storage cassette that are removably mounted in them. According to the present disclosure, it is possible to provide an image forming apparatus that can discriminate whether or not a sheet feed unit is inserted with a simple structure.

What is claimed is:

1. An image forming apparatus comprising:

an apparatus main body;

a sheet storage cassette removably mounted in the apparatus main body, the sheet storage cassette including a sheet storage portion in which sheets are stored;

a sheet stacking plate of which an upstream-side end part in a sheet feed direction is pivotably supported on a bottom face or a side face of the sheet storage portion and on a top face of which the sheets are stacked; and a lift mechanism which raises and lowers the sheet stacking plate;

a sheet feed unit removably mounted in the apparatus main body, the sheet feed unit feeding out the sheets stacked on the sheet stacking plate;

a first detection sensor which detects presence or absence of the sheets stacked on the sheet stacking plate;

a second detection sensor which detects a top face of the sheets stacked on the sheet stacking plate raised by the lift mechanism;

a cassette detection sensor which detects mounting of the sheet storage cassette;

a driving device which transmits a driving force to the lift mechanism; and a controller which controls driving of the driving device, wherein the sheet feed unit includes a first actuator which switches detection states of the first detection sensor according to the presence or absence of the sheets stacked on the sheet stacking plate; and a second actuator which switches detection states of the second detection sensor according to a position of the sheet stacking plate or of a top face of the sheets stacked on the sheet stacking plate, and the controller operating such that, with the cassette detection sensor detecting the mounting of the sheet storage cassette, when the first detection sensor detects that the sheets are not stacked on the sheet stacking plate by detecting the first actuator, the controller determines that the sheet feed unit is in a mounted state based on presence of the first actuator, and when the first detection sensor detects that the sheets are stacked on the sheet stacking plate, the controller drives the driving device to make the lift mechanism raise the sheet stacking plate and when the second detection sensor detects the top face of the sheets by detecting the second actuator, the controller determines that the sheet feed unit is in the mounted state based on presence of the second actuator, and when the second detection sensor does not detect the top face of the sheets even after the driving device is driven for a predetermined time, the controller determines that the sheet feed unit is in a dismounted state based on absence of the second actuator.

2. The image forming apparatus of claim 1, wherein the first detection sensor includes a first detector including a light emitter and a light receiver, and the second detection sensor includes a second detector including a light emitter and a light receiver, and the first actuator switches the first detector between a light-shielded state and a light-transmitted state according to the presence or absence of the sheets stacked on the sheet stacking plate, and the second actuator switches the second detector between a light-shielded state and a light-transmitted state according to the position of the sheet stacking plate or of the top face of the sheets stacked on the sheet stacking plate.

3. The image forming apparatus of claim 1, further comprising:

an indicating device which indicates a mounting state of the sheet feed unit, wherein the controller issues an indication requesting the mounting of the sheet feed unit by using the indicating device by means of determining that the sheet feed unit is in the dismounted state.

4. The image forming apparatus of claim 3, wherein the indicating device indicates the presence or absence of the sheets in the sheet storage cassette, and the controller issues an indication requesting replenishment of sheets into the sheet storage cassette when the cassette detection sensor detects the mounting of the sheet storage cassette and in addition the first detection sensor detects that the sheets are not stacked on the sheet stacking plate.

5. The image forming apparatus of claim 1, wherein the sheet feed unit includes:

a pickup roller which makes contact with the top face of the sheets stacked on the sheet stacking plate to feed out the sheets;

a feed roller arranged on a downstream side of the pickup roller in a sheet feed direction;

a retard roller which forms a nip with the feed roller and which feeds out the sheets while separating one sheet from the next; and a roller holder which rotatably supports the pickup roller and the feed roller, the roller holder making the pickup roller pivot about a rotary shaft of the feed roller as a pivot, and the first actuator includes:

a shaft extending in a direction perpendicular to the sheet feed direction and rotatably supported on the sheet feed unit;

a first light-shielding plate formed at one end of the shaft, the first light-shielding plate shutting off or opening up an optical path of the first detector of the first detection sensor; and a contact piece formed at another end of the shaft, the contact piece making contact with a bunch of sheets in the sheet storage cassette.

6. The image forming apparatus of claim 5, wherein the second actuator is arranged on the roller holder, and includes a second light-shielding plate which shuts off or opens up an optical path of the second detector of the second detection sensor.

* * * * *